United States Patent [19]

Liu

[11] Patent Number: 4,856,537

[45] Date of Patent: Aug. 15, 1989

[54] ASHTRAYS

[76] Inventor: Yee M. Liu, 22 Framfield Way, Eastbourne, Sussex, England

[21] Appl. No.: 142,206

[22] Filed: Jan. 11, 1988

[51] Int. Cl.[4] ..... A24F 19/00

[52] U.S. Cl. ..... 131/240.1; 131/235.1

[58] Field of Search ..... 131/235.1, 240.1, 241, 131/231

[56] References Cited

U.S. PATENT DOCUMENTS

| | | | |
|---|---|---|---|
| 1,813,467 | 7/1931 | Smith | 131/235.1 |
| 2,184,994 | 12/1939 | Dyke | 131/235.1 |
| 2,638,905 | 5/1953 | Morrison | 131/240.1 |
| 2,974,821 | 3/1961 | Lamont | 131/235.1 |
| 3,952,753 | 4/1976 | Klingler | 131/235.1 |
| 4,239,049 | 12/1980 | Perry | 131/240.1 |
| 4,241,742 | 12/1980 | Hilding | 131/235.1 |

*Primary Examiner*—V. Millin
*Assistant Examiner*—J. Welsh
*Attorney, Agent, or Firm*—Anthony A. O'Brien

[57] ABSTRACT

An ashtray has at least one cigarette-receivable recess in an upper rim surface, the one or each recess comprising a generally U-shaped channel having width or depth dimensions which are sufficient to reduce the combination rate or extinguish a burning cigarette when the burning end reaches or is located within the recess. At least one recess is angled upwardly with respect to the base and gripping formation are provided at each recess to assist retention of a burning cigarette as a safety feature. A supporting platform may be included for temporarily resting a cigarette and permitting relighting of cigarettes after use of the present ashtray.

8 Claims, 3 Drawing Sheets

ASHTRAYS

BACKGROUND OF THE INVENTION

1. Field of the Invention

This invention relates to an improved ashtray.

2. Description of the Prior Art

In a well known form of ashtray grooves are provided in the upper rim of an ashtray for supporting a cigarette. When the cigarette rests in the groove the burning end is placed above the ash receptacle. When the cigarette burns for a sufficient interval the centre of gravity is altered whereby it may tilt backwards and fall onto a potential combustible surface.

One form of ashtray for controlling the burning rate is known from U.S. Pat. 4241742. This comprises a series of horizontal grooves adapted to receive a cigarette and affect the rate of combustion. Other forms of ashtray are known, for example, from prior U.S. Pat. Nos. 3,675,662 and 4,239,049. Smokers may leave cigarettes on ashtrays and possibly forget them. Careless smokers may be responsible for accidental fires when an unextinguished cigarette falls off an ashtray onto a combustible surface. It is not always convenient for the smoker to continuously smoke a single cigarette and during smoking, smokers frequently use an ashtray for temporarily resting their cigarettes. Indeed the smoker may be performing tasks whilst it is inconvenient or impossible to be simultaneously holding a cigarette. For example, cooks or shopkeepers may require both hands for cooking or serving and resort to an ashtray as a temporary receptacle for their cigarette.

Smokers may extinguish part-used cigarettes by a pressure and twisting motion which damages the cigarette and therefore makes it unsuitable for further use. Occasionally smokers may forget that they have left a cigarette burning in an ashtray and this can represent a fire hazard. Accidental fires may also result from displacement of a burning cigarette from an ashtray wherein the burning end rests in the ash receptacle and a side of the cigarette is supported on a groove part of the ashtray. Such cigarettes may fall backwards out of the ashtray as the combustion process proceeds.

Not all ashtrays provide self-actuating or automatic means for reducing the combustion rate of a burning cigarette. The expression "reducing the combustion rate" is used herein to mean slowing down of the cigarette burning process but not extinguish thereof. Cigarettes allowed to remain upon ashtrays continue to burn at their conventional rate unless manually extinguished. It should be noted that manual extinguishing of a cigarette can be inconvenient and wasteful. It may lead to contamination of ash upon fingers. Attempts to manually extinguish cigarettes are usually permanent in the sense that any unused portion of tobacco is effectively wasted. It is believed that some smokers would resume smoking a previously extinguished cigarette providing it is not significantly deformed.

There is also the risk that other people, particularly young children, may pick up a burning cigarette from an ashtray through curiosity. Apart from potential harm to the child this may also lead to a more serious fire.

Many ashtrays currently in use are for smokers in public places, e.g., restaurants, hotels, public houses and the like. So ashtrays for safer smoking should be able to cater effectively for variations in cigarette length and diameter, and for cigarettes which are partially deformed in storage as may be the case with cigarettes stored in soft packets.

SUMMARY OF THE INVENTION

It is from a consideration of known ashtrays and their method of use which has led to the development of the present invention. Use of ashtrays according to the invention may result in up to 30% savings of unused tobacco in smoked cigarettes. Use of the present ashtrays may also improve safety in that risks of fires from inadvertently unattended cigarettes can be significantly reduced.

According to one aspect of this invention there is provided an ashtray having at least one cigarette-receivable recess in an upper surface, the said one or each recess comprising a generally U-shaped channel whose width and/or depth is/are sufficient to reduce the combustion rate of and/or extinguish a burning cigarette when the burning end reaches or is located within the recess, one or more of the recesses having cigarette-gripping formations at one end thereof.

The invention provides in a second aspect an ashtray as defined above wherein the or one recess has an opening adjacent a supporting platform upon which part of a cigarette can rest, the platform including at or near an end spaced from that recess cigarette gripping means to assist cigarette location or retention.

In embodiments of the invention of the ashtray may comprise four recesses, preferably each recess being situated at the corner of a generally rectangular base. For those embodiments of the invention which employ a platform adjacent the end of one of the recesses then that one recess adjacent the platform will preferably be spaced away from the corner of an ashtray. The or each recess may extend upwardly with respect to the base part of an ashtray and at an acute angle with respect to that base part. In this respect there is an important distinction over prior ashtrays which have generally horizontal recesses or recesses which extend downwardly towards the base.

In embodiments of the invention which use the supporting platform as disclosed above then that recess also preferably extends in the same direction with respect to the base as do the other recesses, i.e. an acute angle away from the ash receptacle part. The burning end of a cigarette may be placed to project beyond ash-receiving end of the recess having such an adjacent platform or such burning end may gradually become located within that recess in use or it may be initially located within that recess. Within the platform there may be provided a depression in alignment with but spaced from the recess adjacent that platform. It has been found that in order to reduce the combustion rate of a burning cigarette end within a U-shaped recess, the maximum width of the recess may be from 5–12 mm preferably 7–10 mm and most preferably from 7.75–9.75 mm. These dimensions are broadly based upon the diameter of a standard manufactured cigarette of 7 or 8 mm diameter. However, the present dimensions could be suitable for cigars, non-standard sized cigarettes, e.g. one of 6 mm diameter and self-rolled cigarettes. It is preferred for one or more of the recesses to have a maximum depth of the order 7–20 mm, preferably 16–18 mm. It is also preferred that the recess has chamfered or rounded shoulders on the upper walls which define the recess. It is most preferred for the recesses to be formed into the rim portion of an ashtray which conventionally may comprise a one-piece integral moulding. Although it would appear the particular length of each recess is not especially critical, we prefer the length of each recess to be of the order 10–40 mm, preferably 15–35 mm and most preferably 20–30 mm.

For any recess, extending adjacent a platform as discussed above the combined length of recess and support platform may be of the order 30–60 mm, preferably 35–55 mm and most preferably 40–50 mm. It is also preferred that for the or each recess the width thereof decreases steplessly with increasing depth.

As will become apparent from the following description of a preferred embodiment, ashtrays according to the invention may be provided with several recesses, any one of which may further include an ash-receiving depression at one end thereof. At least one of the recesses includes cigarette gripping means which may be in the form of width reducing formations such as projections, dimples or the like at or near one end of and within the recess.

Preferred ashtrays in accordance with the invention can include a base part which together with an upstanding rim in which the or each recess is located, defines an ash receptacle. The base part forming the receptacle for ash preferably includes one or more regions of upstanding projections such as projecting dimples. Projecting dimples may take a variety of forms, e.g. part spherical, conical, cylindrical, linear or the like. Most preferably each recess, including any adjacent a platform as previously described, is associated with one region of upstanding projections.

The gripping means at one end of at least one recess, or on the platform for those embodiments of the invention incorporating a platform, may comprise projecting dimples. The projecting dimples may serve to engage the outer surface of a cigarette and so prevent slippage thereof as an important secondary safety feature. If dimples are employed they may be spaced apart by e.g. 5.5–9 mm, preferably 7.75–8.75 mm, particularly for those gripping means which may be present on any platform and of the order 5.5–6.5 mm spacing for any other recess. The shape of any such projecting dimples may correspond with the shapes discussed above for any upstanding projections in the base part.

BRIEF DESCRIPTION OF THE DRAWINGS

In order that the invention may be illustrated and carried into effect, embodiments thereof will now be described by way of example only with reference to the accompanying drawings and in which.

DESCRIPTION OF PREFERRED EMBODIMENTS

Figure 1:
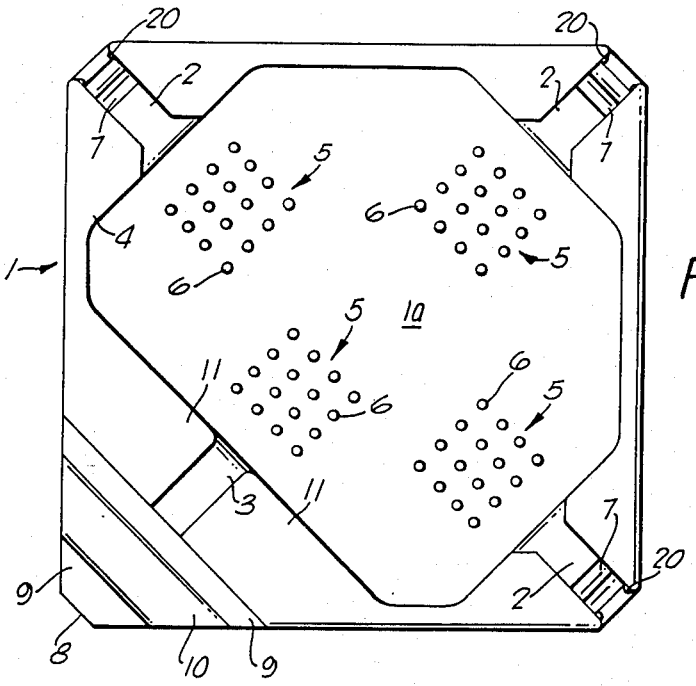
FIG. 1 is a plan view of an ashtray.
Figure 2:
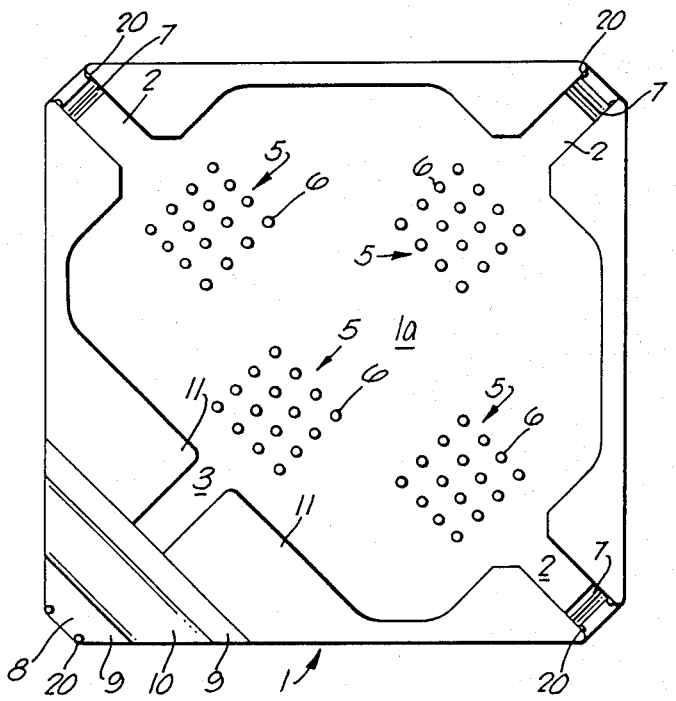
FIG. 2 is a plan view of a modified ashtray.

Referring firstly to FIGS. 1 and 2 of the drawings, the ashtray 1 has a base 1*a* approximately 3 or 4 mm thick forming an ash receptacle or ash-receiving well portion, being generally square shaped. Three substantially identical recesses 2 are provided at three corners of the ashtray. A fourth recess 3 is provided in spaced relationship from the fourth corner 8 of the ashtray adjacent a supporting platform 9,10. Each recess 2, 3 is cigarette receivable in that a burning cigarette can be placed in the recess and left there. Each recess 2, 3 comprises a generally U-shaped channel whose maximum width is 0.75 mm greater than the diameter of a standard diameter cigarette at 8 mm diameter. The maximum depth of the recess is of the order 17 mm, the length about 25 mm, and as can be seen from the subsequent, FIGS. 5 and 6, the width of the U-shaped channel decreases with increasing depth towards the bottom. Part of this channel may have a width which is less than or equal to the diameter of a standard size cigarette e.g. a part whose width is 6 mm. It is preferred that the height of the ashtray above a flat resting surface should be about 9 or 10 mm at the end of the platform or the corresponding end of a recess.

Each of the recesses is formed in an upstanding rim part 4 which is conveniently formed around the periphery of the ashtray such as by a moulding process, thereby forming a peripheral wall. The base 1*a* of the ashtray includes regions 5 of upstanding partspherical or other shaped projections 6 adjacent one end of each recess. These textured surface parts help to prevent a burning cigarette from slipping further into the ashtray as may be seen from FIGS. 4 and 9.

Figure 3:
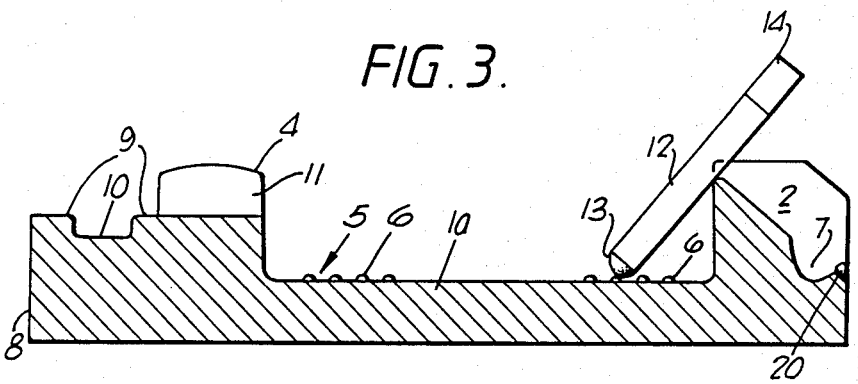
FIG. 3 is a cross sectional detail of FIG. 1.
Figure 4:
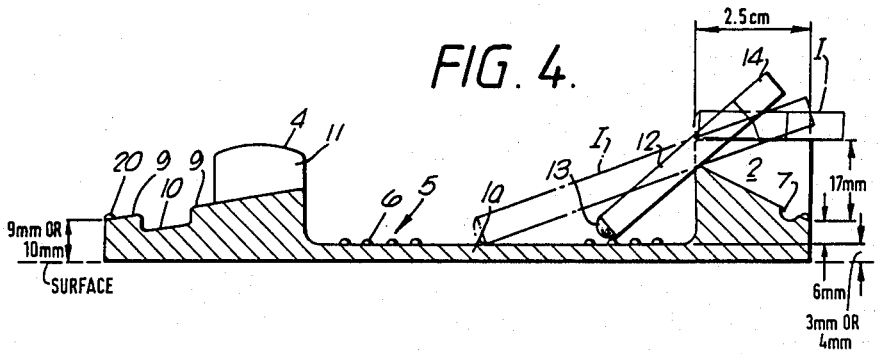
FIG. 4 is a cross sectional detail of FIG. 2.

Referring also to FIGS. 3 and 4, the recesses 2 are arranged to slope at an acute angle with respect to the base 1*a* and in a direction away from the base. This is particularly so for the embodiment of FIG. 4 whereby all recesses are angled upwardly and away from the base whereas the FIG. 3 embodiment being a less preferred form, has one recess (adjacent the platform) which lies in parallel to the base. This recess 3, being spaced away from the respective corner 8 of the ashtray, generally has similar depth and width dimensions to the three other recesses 2. One end of this recess lies adjacent the platform 9, 10 in which a depression 10 is located to assist picking up a cigarette lying on the platform. In the more preferred arrangement of FIGS. 2 and 4 the platform is provided at its remote end adjacent the corner with gripping means 20 comprising a pair of spaced dimples or inwardly directed formations which may be of the order 3 mm in height and in diameter. A burning cigarette may be placed within this recess 3 with the inhalation end resting upon the generally raised platform 9. The particular recess 3 is defined by side portions 11 of the rim, which side portions have for convenience rounded-off upper edges as shown 4 in FIGS. 3 and 4.

Use of the ashtray is shown in FIGS. 3 and 4 in which a cigarette 12 has a burning end 13 resting on projecting dimples 6 in the base part. The inhalation or filter end 14 projects uppermost. If this cigarette should tip backwards, which it may through alteration of the centre gravity during combustion, the additional dimples 20 will serve to grip and thus retain the cigarette and the dimensions of the recess 2 will be such as to cause the rate of combustion to decrease to the point of extinguishing same. This process of reducing the combustion rate and/or extinguishing may be due to heat transfer between the burning end of the cigarette and the material of which the ashtray is made and/or lack of oxygen within the recess. Whilst the combustion process should be terminated with the burning cigarette end within the recess, if it does not then the gripping means 20 ensures that the cigarette does not become accidentally dislodged therefrom. In other words the gripping means 20 provide an important secondary safety function by preventing burning cigarettes from falling out of the ashtray recesses on to potentially combustible surfaces. This is also true of the gripping means located on the platform 9, 10.

Figure 5:
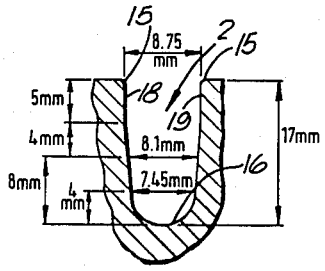
FIG. 5 is a part sectional view through one form of channel recess.
Figure 6:
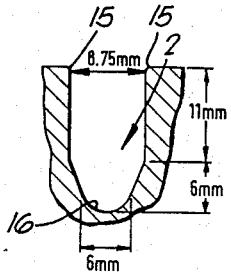
FIG. 6 is a corresponding view of a slightly modified channel recess.

Referring to FIGS. 5 and 6 of the drawings, suitable forms of recesses 2 are shown at their maximum depth which may have rounded shoulders 15 and a curved lower base 15. Referring to the less preferred FIG. 5 arrangement, the width of the recess at its widest part is of the order 8.75 mm which decreases in two stages to 8.1 mm and then 7.45 mm. The maximum depth of this particular U-shaped recess is of the order 17 mm.

Figure 7:
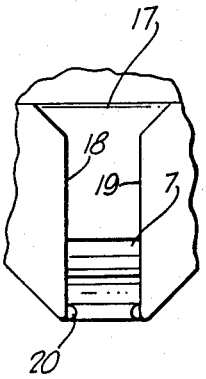
FIG. 7 is a plan view of one form of recess.

The more preferred form of recess of FIG. 6 has a similar width at its widest part of the order 8.75 mm which decreases towards the bottom to some 6 mm. The maximum depth of this U-shaped recess is again of the order 17 mm. Referring to FIG. 7 of the drawings an enlarged detailed plan view of a recess 2 is shown. The forward end 17 of the recess is enlarged. The maximum width of the recess at its widest part is to be taken as being measured between parallel sides 18 and 19. The end of the recess remote from the forward end 17 includes an ash-receiving depression 7. At or near the end of the recess remote from the base projections in the form of dimples 20 are provided as gripping means to grip the sides of a cigarette inserted in the recess. The dimples 20 in the FIG. 7 arrangement may have a diameter of the order 1.5 mm and a spacing apart of some 6 mm. This important secondary feature provides a means for retaining almost any part of a cigarette inserted therein and to prevent it from falling backwards out of the ashtray.

Figure 8:
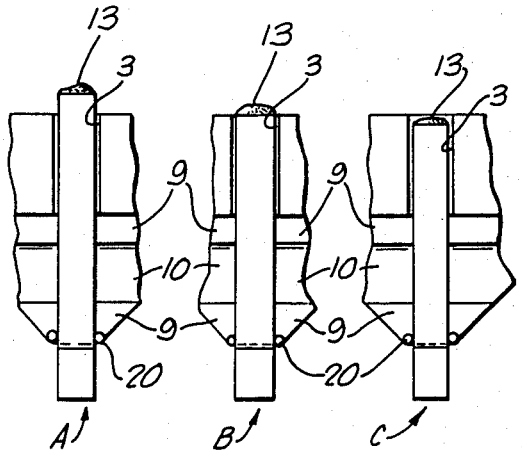
FIG. 8 illustrates use of a cigarette on that part of an ashtray incorporating a platform.

FIG. 8 illustrates use of the particular recess 3 adjacent the platform 9, 10 for reducing the combustion rate and for extinguishing a cigarette respectively. When a cigarette is placed into the recess with its burning end in the position of cigarette A it will be extinguished after a predetermined time interval. This position will be useful for smokers who do not want to extinguish their cigarettes permanently but expect a delay before resuming smoking of the same cigarette. Thereby they can re-light it if necessary and the cigarette has not been deformed by any twisting or pressure movements usually associated with manual extinguishing. It is important to note that the cigarette will be extinguished and not burned to its end thereby achieving an economy in consumption of tobacco.

When a cigarette is placed in the recess with its burning end according to cigarette B the combustion rate will be reduced to the point of extinguishing after some 4–1 minutes or so. The combustion rate will be significantly reduced until extinguishing thereby reducing the quantity of smoke discharged from the cigarette and again making it last longer. When a cigarette is placed in the recess with its burning end as shown by cigarette C it should be extinguished in some 60 seconds or so. Cigarettes may be placed with confidence in any of the relative positions A, B or C depending upon requirements whilst, the smoker has the satisfaction of knowing that the risk of the cigarette falling out of the ashtray onto a combustible surface is significantly reduced or even eliminated.

When the cigarette has been placed in recess 3 and become extinguished either intentionally or accidentally the smoker may simply re-light without further wastage. This represents a significant improvement over attempting to re-light manually extinguished cigarettes which have been deformed. Placing a cigarette as shown by cigarettes A, B or C also ensures that the cigarette itself does not become physically damaged, distorted or contaminated with ash from the ash-receiving receptacle. Smokers find it most undesirable to attempt re-lighting of cigarettes which have become significantly contaminated by ash.

Figure 9:
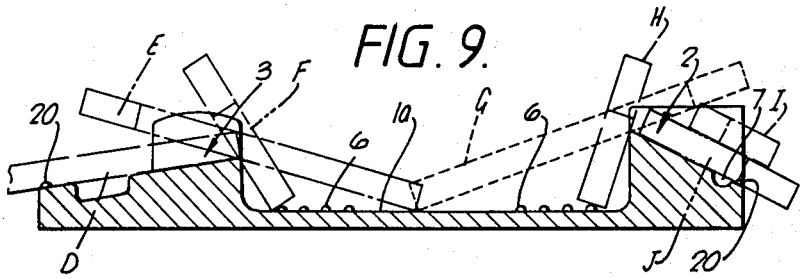
FIG. 9 is a cross sectional view according to FIG. 4 but with a plurality of cigarettes places thereon.

Referring lastly to FIG. 9 of the drawings this shows that almost any size or length of cigarette D–J may be used with embodiments of the present ash tray. Cigarette D illustrates a 100 mm long cigarette. In the position shown for cigarette D this may be balanced on the platform with its burning end in any of the positions discussed above for cigarettes A, B or C. If the burning end should become dislodged from or simply pass through the recess 3 then the cigarette could lose balance and tip backwards whereupon its filter end will rest on the surface which also supports the ashtray. The gripping means 20 will then serve to prevent cigarettes (such as D after further combustion) from rolling side to side as a result of this tipping backwards motion. Thus this is an important second safety factor. The use of such gripping means 20 at or towards the end of the platform is particularly advantageous for partly used, shorter or smaller than standard sized cigarettes such as those of 7 mm or 6 mm diameter. These will take longer to be extinguished in the channel, especially in windy conditions. The cigarettes E and F are shown with the filter end raised, not obstructed by any recess and therefore easy to retrieve for further smoking.

Cigarettes G and H may represent recently lit or part used cigarettes which need not be deformed, distorted or damaged when using the present ashtray. During combustion the inhalation end can fall back into the recess 2. The positioning and quantity of upstanding projections 6 on the base permit longer cigarettes to slide further towards the centre of the ashtray in accordance with cigarette G. Cigarette J has been placed in the recess 2 for the purpose of extinguishing without any twisting motion or use of the base or upstanding projections. Cigarette J will be held tight by the gripping means 20 and will continue combustion until the burning end enters the recess in a position corresponding to that of cigarette C in FIG. 8, whereafter it will be shortly extinguished. Because the cigarette is held tightly there is no sideways motion upon continued combustion and the cigarette will self-extinguish even if forgotten by the smoker. Cigarette I has been inadvertently placed above previously extinguished cigarette J, but this too will self-extinguish after a time interval.

In the event that cigarette G is inadvertently left in place it may fall backwards after an interval of time and may stay on top of cigarette J to assume the position of cigarette I. It will not slide out of the ashtray because there is insufficient side clearance in the 8.75 cm channel.

It may be noted that the gripping means, preferably comprising a pair of spaced projecting dimples, control sideways rolling motion of cigarettes. This is a useful secondary safety feature. Those recesses 2 which are not adjacent a supporting platform have the gripping means actually within the recess whereas that recess 3 which lies adjacent a supporting platform has associated gripping means spaced apart from that recess. It is most preferred for the gripping means at the platform to be located actually at the end of that platform. The projections should be at least 3 mm high.

Embodiments of the ashtray may also be used to extinguish cigarettes completely in the conventional pressure and twisting motion. They also serve as convenient ash receptacles but offer a significant improvement in reducing the risk of fire hazards association with unattended cigarettes in ashtrays. Smokers may economise on tobacco and may re-light part-smoked cigarettes which are not materially damaged. Cigarettes may be left in the ashtray to regulate the combustion rate and consequently determine the time delay before a burning cigarette is extinguished.

Each of the U-shaped recesses may be dimensioned to hold a cigarette in position firmly by frictional fit with the gripping means. This not only assists the combustion rate reduction but also holds the cigarettes more securely in the ashtray. The present ashtray encourages smokers to use one of the recesses for resting their cigarettes rather than any portion of the base or sidewall.

I claim:

1. An improved safety ashtray having a peripheral wall surrounding a central ash-receiving well portion, said wall having one or more transverse channels extending from the outside to the inside, each channel having a width and depth such that a burning cigarette may freely be located therein for combustion reduction and extinguishment when the burning end reaches the inside of the wall at the channel, characterized in that the base of the channel slopes downwardly from the inside of the peripheral wall to the outside of the peripheral wall, the height of the base of the channel at the outside of the peripheral wall above a surface on which the ashtray stands being such that a cigarette end resting on such surface will be retained within the channel, the base of the channel adjacent the outside of the peripheral wall including inwardly directed formations adapted to grip and retain a cigarette located within the channel.

2. An ashtray according to claim 1, wherein the surface of the ash-receiving well includes a region having spaced apart upstanding dimples.

3. An ashtray according to claim 1, wherein the base of the channel adjacent the outside peripheral wall has an ash-receiving depression.

4. An ashtray according to claim 1, having a rectangular shape with a cigarette receiving channel at each corner thereof.

5. An improved safety ashtray having a peripheral wall surrounding a central ash-receiving well portion, said wall having one or more transverse channels extending from the outside to the inside, each channel having a width and depth such that a burning cigarette may freely be located therein and will be extinguished or the combustion thereof will be substantially reduced, when the burning end reaches the inside of the wall at the channel, characterized in that the base of the channel slopes downwardly from the inside of the peripheral wall to the outside of the peripheral wall, a platform having a surface coextensive with the base of the channel and extending beyond the outside of the peripheral wall to a lip defining an edge of the ashtray, said edge having two laterally spaced projections between which a cigarette may rest, the height of said edge above a surface on which the ashtray stands being such that a cigarette end resting on such surface will be retained on said platform edge by the spaced projections.

6. An ashtray according to claim 5, wherein the platform has a transverse recess to facilitate placement and retrieval of a cigarette relative to said wall.

7. An ashtray according to claim 5 having a rectangular shape with a cigarette receiving channel and platform at each corner thereof.

8. An improved safety ashtray having a peripheral wall surrounding a central ash-receiving well portion, said wall having at least two transverse channels extending from the outside to the inside, each channel having a width and depth such that a burning cigarette may freely be located therein for combustion reduction and extinguishment when the burning end reaches the inside of the wall at the channel, characterized in that the base of at least one channel slopes downwardly from the inside of the peripheral wall to the outside of the peripheral wall, the height of the base of the channel at the outside of the peripheral wall above a surface on which the ashtray stands being such that a cigarette end resting on such surface will be retained within the channel, the base of the channel adjacent the outside of the peripheral wall including inwardly directed formations adapted to grip and retain a cigarette located within the channel and further characterized in that the base of at least one other channel slopes downwardly from the inside of the peripheral wall to the outside of the peripheral wall, a platform having a surface coextensive with the base of the channel and extending beyond the outside of the peripheral wall to a lip defining an edge of the ashtray, said edge having two laterally spaced projections between which a cigarette may rest, the height of said edge above a surface on which the ashtray stands being such that a cigarette end resting on such surface will be retained on said platform edge by the spaced projections.

* * * * *